US006190500B1

(12) United States Patent
Mohan et al.

(10) Patent No.: US 6,190,500 B1
(45) Date of Patent: Feb. 20, 2001

(54) MULTILAYER LINERBOARD HAVING IMPROVED PRINTING PROPERTIES AND RELATED METHOD OF MANUFACTURE

(75) Inventors: K. Krishna Mohan, Staten Island; Michael J. Smith, Tuxedo Park, both of NY (US); Alexander A. Koukoulas, Ridgewood, NJ (US)

(73) Assignee: International Paper Company, Purchase, NY (US)

( * ) Notice: Under 35 U.S.C. 154(b), the term of this patent shall be extended for 0 days.

(21) Appl. No.: 09/165,947

(22) Filed: Oct. 2, 1998

(51) Int. Cl.[7] ..... D21H 11/00; D21H 13/00; D21H 23/00

(52) U.S. Cl. ..... 162/134; 161/135; 161/136; 161/137; 161/123; 161/125; 161/129; 162/147

(58) Field of Search ..... 162/123, 125, 162/129, 135, 137, 136, 147, 134

(56) References Cited

U.S. PATENT DOCUMENTS

| | | | | |
|---|---|---|---|---|
| 4,596,633 | | 6/1986 | Attwood | 162/206 |
| 5,033,373 | | 7/1991 | Brendel et al. | 100/38 |
| 5,080,758 | * | 1/1992 | Horng | 162/130 |
| 5,147,505 | * | 9/1992 | Altman | 162/129 |
| 5,163,364 | | 11/1992 | Bubik et al. | 100/38 |
| 5,251,551 | | 10/1993 | Abe et al. | 100/93 RP |
| 5,378,497 | | 1/1995 | Johnson et al. | 427/211 |
| 5,400,707 | | 3/1995 | Neider et al. | 100/93 RP |
| 5,483,873 | | 1/1996 | Koivukunnas | 100/38 |
| 5,524,532 | | 6/1996 | Koivukunnas | 100/38 |
| 5,614,064 | | 3/1997 | Nykopp | 162/358.3 |

FOREIGN PATENT DOCUMENTS

| | | |
|---|---|---|
| 94/28239 | 12/1994 | (WO) . |
| 96/28609 | 9/1996 | (WO) . |

OTHER PUBLICATIONS

Wikström et al., "Calendering of coated paper and board in an extended soft nip," Nordic Pulp and Paper Research Journal, vol. 12, No. 4, pp. 289–298 (1997).

* cited by examiner

*Primary Examiner*—Stanley S. Silverman
*Assistant Examiner*—Dionne A. Walls
(74) *Attorney, Agent, or Firm*—Ostrager Chong & Flaherty LLP

(57) ABSTRACT

A multilayer linerboard product having a top layer made up of bleached/unbleached virgin or recycled pulp and at least one bottom layer made up of unbleached pulp. The external surface of the top layer has reduced gloss mottle and improved printing properties. In particular, the top surface of the multilayer linerboard has a Parker smoothness less than 6.5 and a Hagerty/Sheffield smoothness in the range of 240 to 280. Print voids on a flexo printed product are less than 0.20% (by area) as measured by image analysis. These improvements are achieved in an extended nip calender section having a heated calender roll, a backing roll or shoe and a conformable belt. Preferably, the nip width is 1 to 25 cm. The temperature of the surface of the heated calender roll is preferably maintained in the range of 300 to 500° F. The nipload between the heated calender roll and the conformable belt is preferably maintained in the range of 500 to 2,500 pli.

3 Claims, 6 Drawing Sheets

MULTILAYER LINERBOARD HAVING IMPROVED PRINTING PROPERTIES AND RELATED METHOD OF MANUFACTURE

FIELD OF THE INVENTION

This invention generally relates to calendering of paper and paperboard to improve printing properties. In particular, the invention relates to calendering of multilayer linerboard having a top layer composed of unbleached/bleached virgin or recycled pulp and intended to be printed on.

BACKGROUND OF THE INVENTION

One of the methods of improving the smoothness of paper/paperboard is to pass the paper/paperboard through one or more heated calendering nips which are at a temperature higher than the temperature of the web. The surface of the paper/paperboard that is to be finished is pressed against the heated roll. The applied heat raises the surface temperature of the paper/paperboard to the glass transition temperature, which causes the fibers to soften and conform to the surface of the roll. The gradient in the temperature tends to lower the glass transition temperature preferentially on the external surfaces of the paper/paperboard, allowing the sheet to achieve a desired smoothness without significant reduction in caliper. However, improved smoothness does not necessarily translate into improved printing performance.

U.S. Pat. No. 4,606,264 to Agronin discloses a method and an apparatus for temperature gradient calendering a web for obtaining improved gloss, smoothness, strength and ink transfer capabilities. By "temperature gradient calendering" is meant that there is a significant difference between the temperatures to which the web surface and the web interior are subjected. A web of paper is passed through a nip formed by an steel roll and a compliant roll. The steel roll is heated to a temperature in the range of 350–400° F. The compliant roll can be made of NOMEX or other resilient material. When the web is compressed by the nip, the hot outer web surface is deformed more than the interior, resulting in a smoother, glossier and stronger web.

The Agronin patent states that it was known to perform standard calendering at a maximum working temperature of usually no more than 200° F., using an iron roll and a compliant roll. In temperature gradient calendering, one or both of the rolls forming a nip is heated to a temperature of at least 350° F. This temperature is "critical but dependent upon the 'flow temperature' of the particular fibers of the web". In order to achieve effective temperature gradient calendering, the nip temperature must be sufficient to cause the surface fibers of the web to deform.

U.S. Pat. No. 5,163,364 to Bubik et al. discloses a method for calendering a paper or cardboard web. Calendering takes place in a calendering zone which operates under pressure with application of heat and moisture. The desired smoothness of the paper web is achieved with a long dwell time in a long calendering zone. A web which is still wet is guided between parallel heatable surfaces which are arranged on opposing sides of the web in facing relationship and pressed against the web. The surfaces are designed to form and hold a given precise contour of the calendering zone over its full length. One surface is constructed as a casing of a heated roll; the second surface is constructed as an endless flexible belt which can be pressed toward the heated roll by means of a supporting element which is concave toward the belt and which is of complementary construction to the radius of the roller casing. The endless belt is made of metal.

U.S. Pat. No. 5,251,551 to Abe et al. discloses a calendering apparatus in which a nip is formed by a chilled roll, a backing roll and an endless elastic belt arranged over the backing roll, whereby a paper sheet to be treated passes between the chilled roll and the endless elastic belt. The Abe patent asserts that a paper sheet having a remarkably improved smoothness and gloss can be obtained using the endless belt, without the disadvantage of a heat buildup. In the case of a prior art soft nip calender having an elastic roll constructed by covering a metallic roll with a layer of synthetic resin having a high thermal resistance, such heat buildup can lead to peeling at the boundary between the metallic roll and the synthetic resin layer, or to heat stress hysteresis in the synthetic resin layer, thereby shortening the working life of the elastic roll.

U.S. Pat. No. 5,400,707 to Neider et al. discloses a hot soft nip calendering apparatus for finishing a continuous sheet of paper. The apparatus includes at least one heated calender roll and a finishing belt which is moved in proximity to the heated calender roll by a plurality of drive rollers and at least one pressure roller. A heated calender nip is defined between the heated calender roller and the pressure roller. When a paper web is passed through the nip, one surface of the paper web is contacted by the heated calender roller and the other surface of the paper web is contacted by the finishing belt. The finishing belt has a smooth surface for contacting the paper web so as to impart appropriate smoothness and gloss characteristics to that surface. The finishing belt preferably comprises a woven substrate formed from a strong flexible synthetic material, such as KEVLAR, polyetheretherketone, RYTON or polyester. The belt further includes a finishing surface formed from a flexible elastomeric material, such as rubber or urethane, finished to a high degree of smoothness (e.g., 50 microinch).

PCT International Publication No. WO 96/28609 to Eriksson et al. discloses a coated paperboard for formed articles which is calendered after coating with a heated calender having a soft extended nip. The term "extended nip" is considered to comprise nip widths of 3 to 10 cm. [Note: In the present application, the term "extended nip" is broadened to encompass nip widths of 1 to 25 cm.] The paperboard consists of a fiber matrix in one, two or more layers and a coating. The calender is constructed to have a relatively soft elastic moving belt supported by a glide body or roll.

The linerboard product which is pertinent to the present invention contains more than one layer of fibers with the top layer being composed of recycled or virgin unbleached/bleached pulp. The plies below the top layer can be more than one and can be virgin kraft or recycled kraft including old corrugated containers. In some cases, the top ply of the multilayer linerboard can be coated with a pigmented or non-pigmented formulation to improve appearance. This product is primarily used as a liner with high visual appeal in corrugated containers. High compressive strength and good print quality are the primary required attributes for this product.

In accordance with a known grade of linerboard having two plies and calendered using a hard nip, gloss mottle and print mottle are apparent in the final printed product. Testing has shown that the mottle can be traced to the formation of the base ply. The hardnip calendering on the machine aggravates the gloss mottle at high nip loads that are required for achieving good smoothness. Conventional soft nip calendering with a deformable nip was considered as an option for alleviating this problem. However, pilot trials showed that conventional soft nip calendering was not successful in reducing the gloss mottling significantly. Thus, there is a need for a method of calendering which will be successful in reducing gloss mottle in multilayer linerboard.

SUMMARY OF THE INVENTION

The present invention is a multilayer linerboard product comprising a top layer of unbleached/bleached virgin or recycled pulp and at least one bottom layer of unbleached pulp. The external surface of the top layer has reduced gloss mottle and improved printing properties. In particular, the extended nip calendering process in accordance with the invention was found to improve smoothness more on a microscale than on a macroscale. This finding is new in that while prior art disclosures of belt calendering discuss the potential of obtaining a gloss uniformity, they do not allude to a preferential improvement of microscale smoothness over macroscale. Here the term microscale is being used to refer to a scale where roughness can be characterized by a test for Parker smoothness while macroscale refers to a length scale where roughness can be characterized using the Hagerty/Sheffield smoothness test. Most production facilities of containerboard use the Hagerty/Sheffield test as a quality control for smoothness measurement. The results from the Parker instrument can be more indicative of the print performance of a product. In accordance with the invention, the top surface of the multilayer linerboard has a Parker smoothness less than 6.5 and a Hagerty/Sheffield smoothness in the range of 240 to 280. Print voids on a flexo printed product are less than 0.20% (by area) as measured by image analysis.

The foregoing improvements are achieved using extended nip calendering, i.e., belt calendering, which includes both endless and seamed belts. Preferably, the nip width is 1 to 25 cm. In accordance with one preferred embodiment, the calendering section comprises a heated calender roll, a backing roll and a conformable belt arranged therebetween. In accordance with another preferred embodiment, greater nip widths can be achieved by using a backing shoe in place of a backing roll. The backing shoe may have either a flat surface for contact with the belt or a convex surface having a radius of curvature greater than the radius of the heated calender roll. The temperature of the surface of the heated calender roll is preferably maintained in the range of 300 to 500° F. The nipload between the heated calender roll and the conformable belt is preferably maintained in the range of 500 to 2,500 pli. Optionally, the top surface of the linerboard may be surface sized and/or moisturized prior to extended nip calendering.

DETAILED DESCRIPTION OF THE PREFERRED EMBODIMENTS

Figure 1:
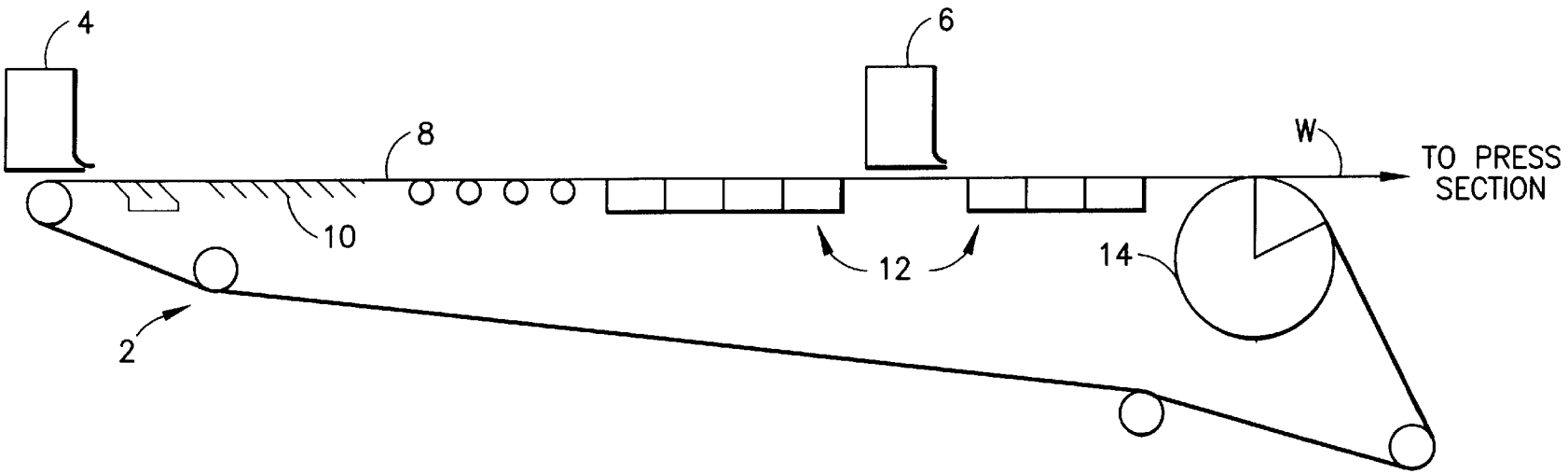
FIG. 1 is a diagrammatic view of a typical arrangement of a Fourdrinier machine fitted with two head boxes suitable for use in manufacturing multilayer linerboard.

The present invention relates to the manufacture of multilayer (two or more layers) linerboard products having a basis weight in the range of 26–60 lb./MSF. Such products are formed on a paper machine capable of producing multilayer product. A paper machine for making a two-ply product is depicted in FIG. 1. This paper machine is a conventional Fourdrinier machine 2 fitted with two head boxes 4 and 6. The furnishes for the bottom and top plies are supplied to the first and second headboxes 4 and 6 respectively by conventional means. Headbox 4 deposits the bottom ply on a forming table 8 of the Fourdrinier machine. At a suitable position along the forming table 8, vacuum is applied using conventional suction boxes 12 and then headbox 6 adds a top ply to the bottom ply. Water is removed by the foils 10 and by the suction roll 14. The web, typically having a solids content of 20–22%, exits the Fourdrinier machine and enters a conventional press section (not shown), which removes additional water (typically to a solids content of 38–42%).

In accordance with one preferred embodiment of the invention, the top layer furnish comprises bleached/unbleached pulp, which can be either recycled or virgin or a combination thereof. The bottom layer furnish is unbleached pulp, which can be either recycled or virgin or a combination thereof. The top layer can be 5–80% of the total basis weight.

Figure 2:
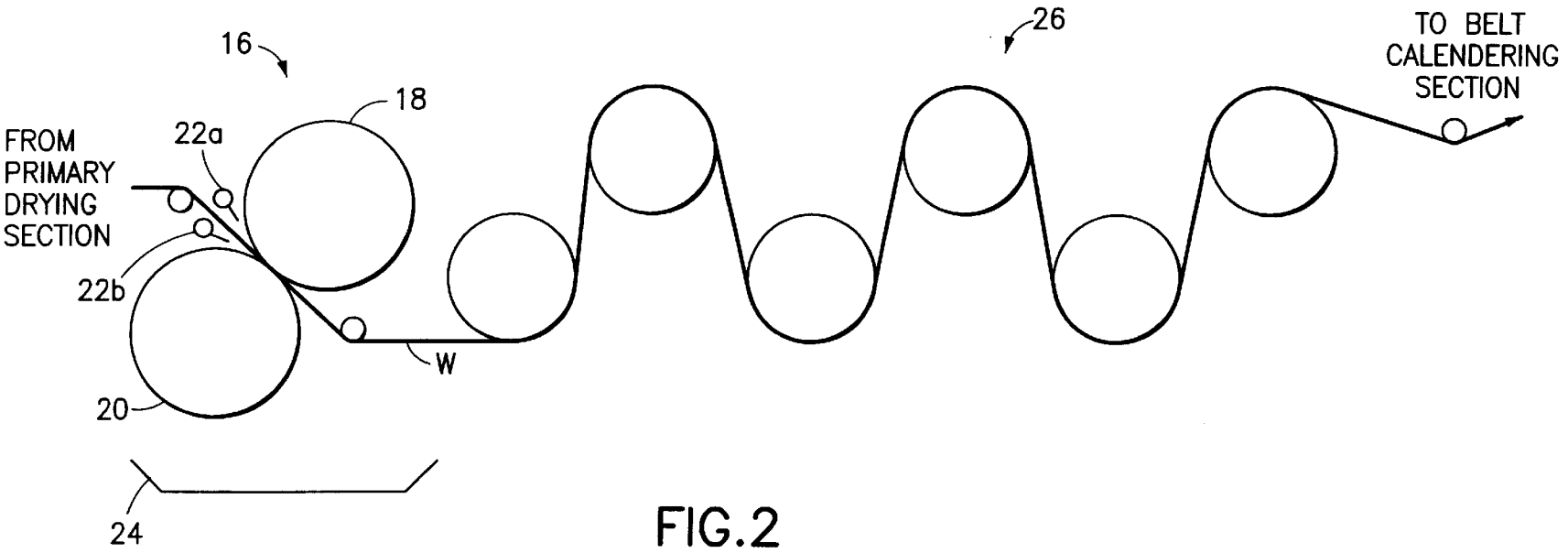
FIG. 2 is a diagrammatic view of a representative size press and dryer section which can be used in manufacturing sized multilayer linerboard.

Following pressing, the two-ply web is dried in the main dryer section (not shown) of the paper machine. The dried web is then surface sized at a size press 16 (e.g., of the puddle or metering type) where the amount of pickup can be controlled. Sizing operations are carried out primarily to provide paper/paperboard with resistance to penetration by aqueous solutions. The treatment also improves the surface characteristics and certain physical properties of the paper/paperboard. During surface sizing, surface voids in the sheet are filled with starch or other binder particles. The size press can be any of the known types in the art and can be used to add a variety of agents for a variety of purposes (e.g., starch and polyvinyl alcohol for strength, pigments such as calcium carbonate, clay for improving the brightness and smoothness of the product). FIG. 2 shows a size press 1 having an inclined configuration. However, it will be appreciated by persons skilled in the art that the use of an inclined configuration is not necessary. In the alternative, the size press may be horizontal or vertical or have metering elements such as a rod or blade. In the inclined size press shown in FIG. 2, the web W passes through the nip between a pair of opposing size press rolls 18 and 20 at an angle of inclination between 0 and 90°, e.g., 45°. The nip formed by rolls 18 and 20 is flooded with sizing solution supplied on both sides of the web by respective banks of solution supply tubes 22*a* and 22*b* spaced in the sheet cross direction. The web W absorbs some of the solution and the unabsorbed solution is removed by the pressure in the nip. The overflow solution is collected in a pan 24 arranged directly below the press rolls and is recirculated back to the nip through the solution supply tubes.

The size press 16 can be used to add a variety of agents for a variety of purposes (e.g., starch and polyvinyl alcohol for strength, pigments such as calcium carbonate, clay for improving the brightness and smoothness of the product. The starch solution (e.g., unmodified, acid modified, pre-oxidized or hydroxyethylated) may have a starch concentration in the range of 1–10%. In addition, the size press solution may optionally contain a lubricant that is compatible with the starch and other binders. This lubricant can belong to a class and of polyethylene emulsions or can be a polyglyceride. The size press-treated paperboard is dried in the dryer section 26 to a moisture level of 1–10%.

Following the size press treatment and drying, the web W is passed through a calendering section. In accordance with the invention, the calender section consists of one or more extended nip calenders, each of which provide a nip width of 1 to 25 cm. Each extended nip calender comprises an endless conformable belt that provides a backing for the bottom surface of the linerboard product while the top surface is pressed against a heated surface to effect hot calendering. Each endless belt can have a fabric base and a polymer coating, such as polyurethane, and can be made with a thickness ranging from 3 to 15 mm and a hardness ranging from 83 Shore C to 68 Shore A.

The surface of the heated calender roll is maintained at a temperature of 300° to 500° F. using internal steam, oil or other heating fluid, or using internal induction coils, and the calender nipload can be varied from 500 to 2,500 pli. The top layer can optionally be moistened using moisturizing means before the paperboard enters the extended calendering nip to further enhance the smoothness or gloss consistent with the principle of moisture gradient calendering. The moisturizing showers may consist of water showers (e.g., hydraulic, air atomized or ultrasonic showers) or steam showers or combination of water showers and steam showers. The moisturizing showers can be used to correct for nonuniformity in moisture profile. If steam showers are used in conjunction with water showers, the preferred configuration would have the steam showers following the water showers. The location of the moisturizing showers will be such that the dwell time between moisturization and the heated nip location varies between 0.05 and 3 sec.

Figure 3:
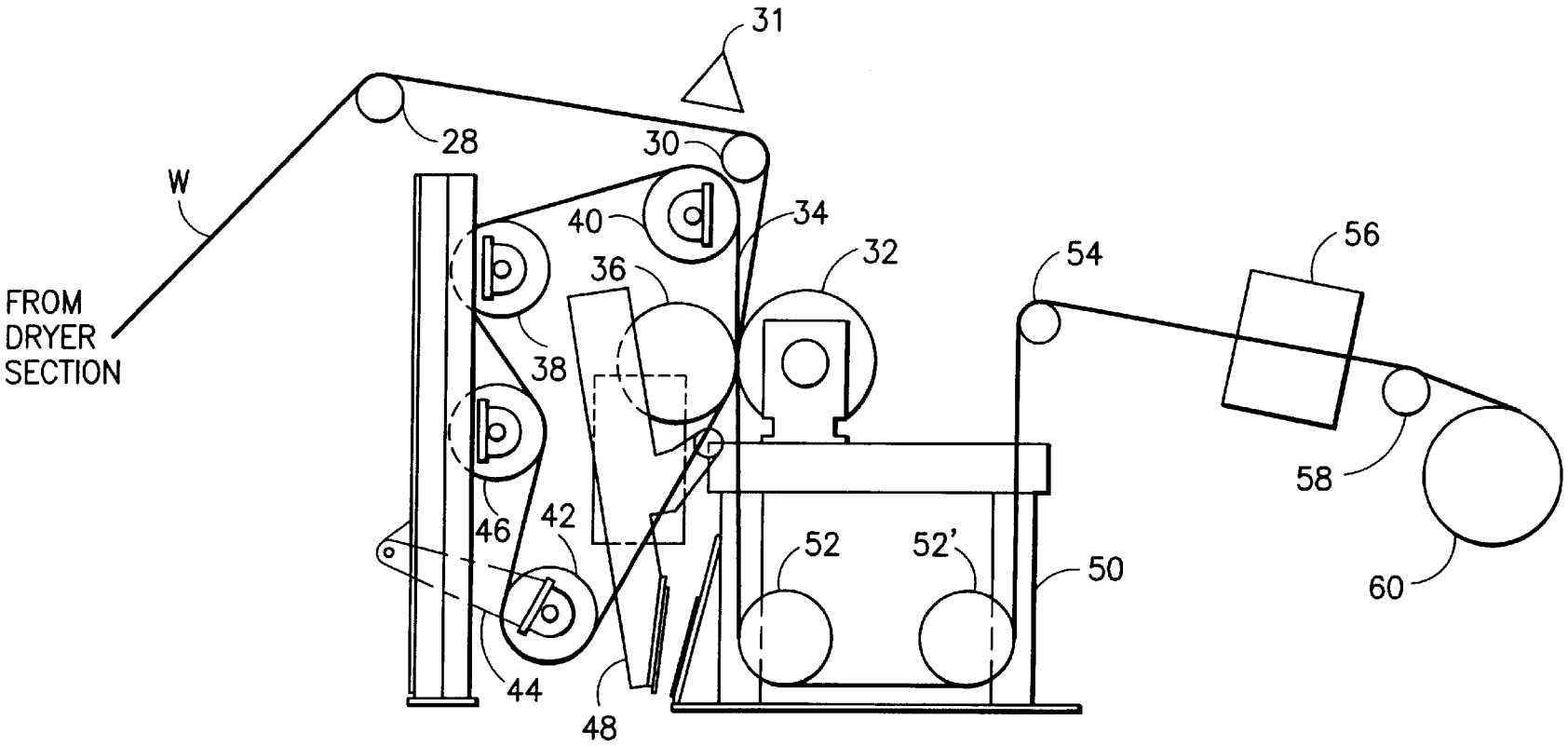
FIG. 3 is a diagrammatic view of an alternative extended nip belt calendering arrangement which can be used in the manufacture of multilayer linerboard in accordance with the invention.

One preferred embodiment of the belt calendering section is depicted in FIG. 3. The tension in the web W can be adjusted by changing the position of tensioning roll 28 utilizing any conventional tensioning device (not shown). The web is wrapped partly around a guide roll 30 and passes through the extended nip formed by a heated calender roll 32 and a conformable belt 34 made of resilient material. The position of guide roll 30 is adjustable to increase the angle of contact of the web W with the heated calender roll 32 upstream of the extended nip, which angle of contact determines the amount of preheating applied to the web by the heated calender roll. Before entering the nip, the web W is optionally moisturized by a bank of moisturizing showers 31 of the type previously described.

The web W is pressed against the heated calender roll 32 by a backing roll 36 which exerts a load on the belt 34. The belt 34, which may be either endless or seamed, circulates on carrier rolls 38 and 40 and tensioning roll 42. The tensioning roll 40 is rotatably mounted on the end of a pivotable arm 44. A guide roll 46 is located outside and in contact with the circulating belt. The backing roll 36 is rotatably mounted on a loading arm 48, which is in turn pivotably mounted on a support frame 50. The loading arm has a first angular position (shown in FIG. 3) in which the backing roll 36 presses the belt 34 against the heated calender roll 32 and a second angular position (not shown in FIG. 3) in which the belt is relaxed and separated from the heated calender roll by a gap.

The heated calender roll surface, when pressed against the top surface of the web W (to which printing will be applied), will apply heat to the top surface. The residence time of the web in the extended nip is sufficiently short that the heat does not penetrate through the entire thickness of the web. The applied heat raises the surface temperature of the linerboard to the glass transition temperature, which causes the fibers to soften and conform to the surface of the heated calender roll 32. The gradient in the temperature tends to lower the glass transition temperature preferentially on the top surface of the linerboard, allowing the web to achieve a desired smoothness and a desired printing performance without significant densification of the sheet. The calendered web passes under guide rolls 52 and 52' and then over guide roll 54. A scanning sensor unit 56 measures the moisture level and basis weight of the web. The web then passes over guide roll 58 on its way to the winding roll 60.

The extended hot nip calendering section depicted in FIG. 3 produces linerboard having improved printing performance on its top surface. If the same printing properties are desired on the bottom surface of the linerboard, then guide roll 54 can be replaced by extended hot nip calendering apparatus which is the mirror image of elements 32 through 48. Utilizing the apparatus shown in FIG. 3 with a hot calender surface temperature of 400° F. and calender nipload which varied from 400 to 1,200 pli, the calendered top surface of a 35 lb./MSF web had the following attributes: (1) The smoothness as measured by the Parker test (TAPPI Test Method T 555 om-94) was better (lower) than 6.5 when measured using a pressure of 10 kgf/cm$^2$ while the smoothness as measured by the Hagerty/Sheffield test (TAPPI Test Method T 538 om-88) was in the range of 240–280; (2) Print voids on a flexo printed product were less than 0.20% (by area) as measured by image analysis (these print voids are also referred to as snowflakes); (3) The Tobias gloss mottle was less than 578 and was reduced by 20–80% as compared to a product that is calendered to the same Sheffield smoothness using a hot steel-steel calender or hot soft nip calender (i.e., a nip formed by a hard roll and a soft-covered roll).

The Tobias gloss mottle was measured using a Tobias mottle tester. The Tobias mottle tester provides an index of print mottle or gloss mottle by measuring small variations in reflected energy from the sample surface. The Tobias mottle tester measures mottle by measuring the variation in reflected optical density from the localized mean optical density. Reflected optical density is measured by illuminating a 3-mm circular area with a perpendicular beam of light and measuring the reflected light (at a 45° angle) with three equally spaced detectors. Typically 64 readings are taken and averaged for each point. The sample is advanced 0.45 mm and another point is evaluated. The average of each point is subtracted from the average density of the points within its localized area (typically 15 mm). The absolute values of these density variations are averaged and multiplied by 1000 to give the Tobias Mottle Index.

The print void data provided above was obtained by conducting image analysis on the flexo printed sheet. In this technique, a small area of the printed surface is imaged and a gray level threshold is used to differentiate between printed areas and voids. The threshold is a function of the color of the ink. Once the voids are identified, a percent area is calculated.

Figure 4:
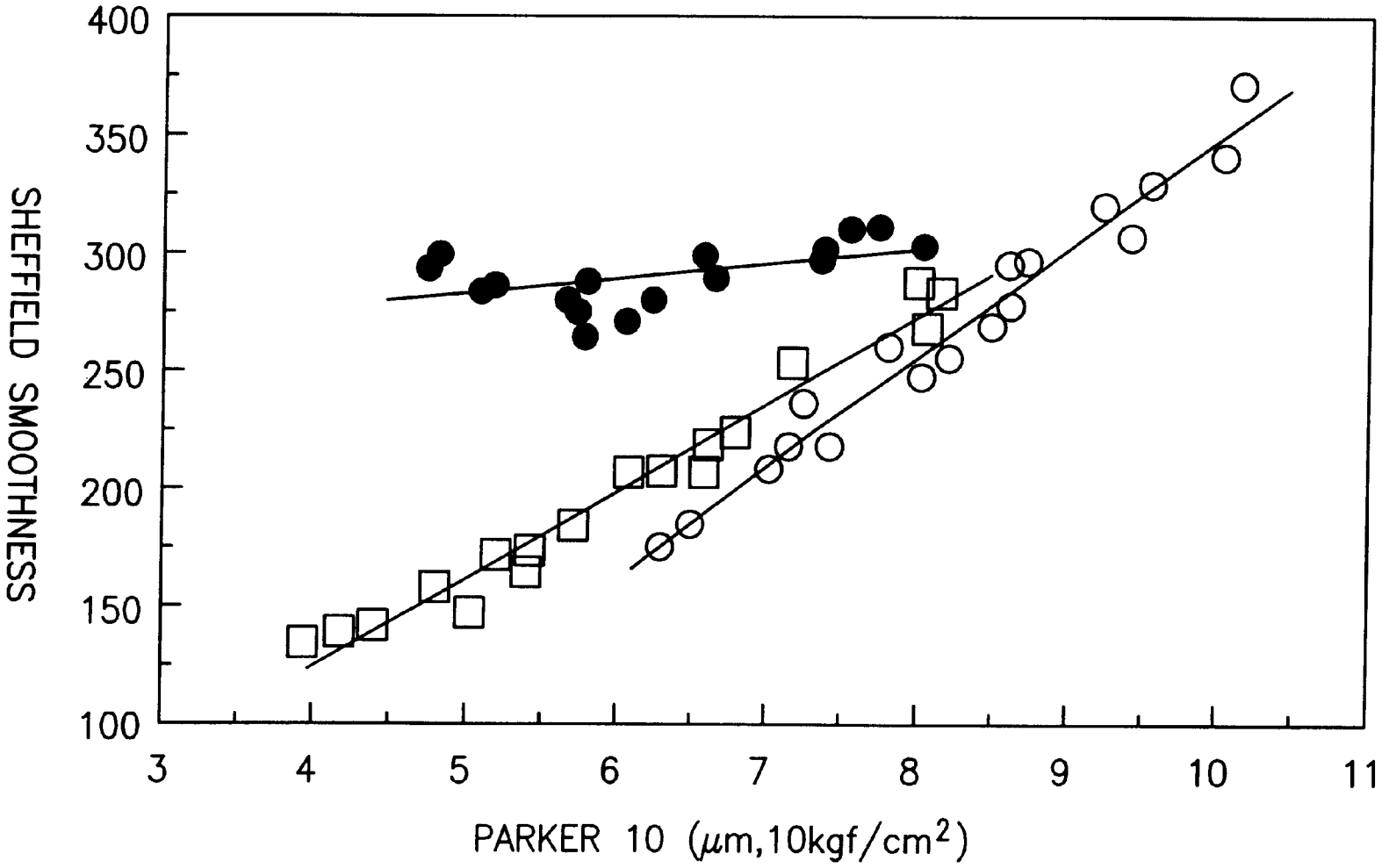
FIG. 4 is a graph of Sheffield smoothness versus Parker 10 smoothness for the top surface of 35 lb./MSF two-ply linerboard samples respectively made by hot soft nip calendering (□), belt calendering (●) and hot hard calendering (○), the surface temperature of the calender roll in each case being 400° F. and the nipload varying in each case from 400 to 1,200 pli.
Figure 5:
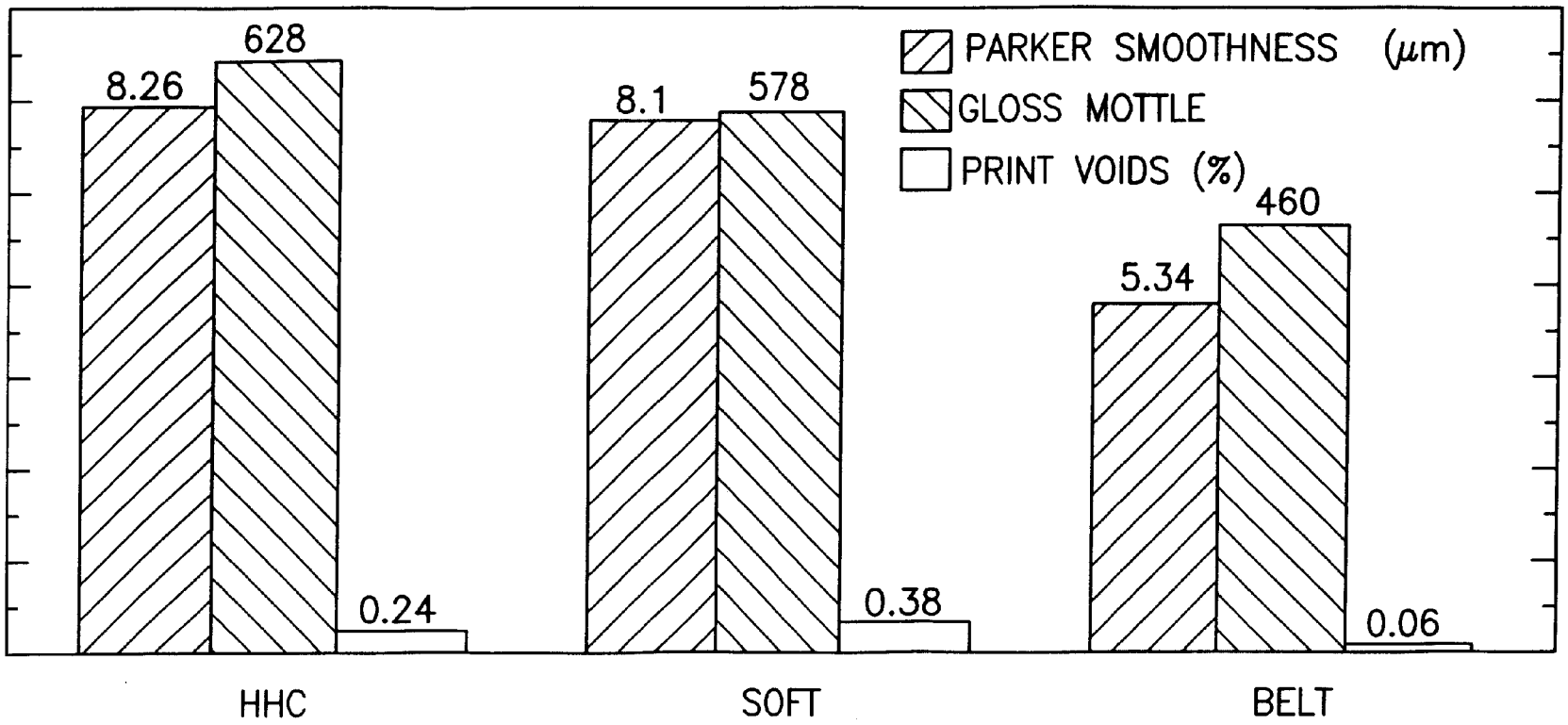
FIG. 5 presents Parker 10 smoothness data (μm), gloss mottle data and print voids data for two-ply linerboard samples manufactured under the best conditions for each of the three calendering methods: hot soft nip, hot hard nip and belt calendering.

The differences in smoothness development using different calendering methods are illustrated in FIG. 4. The data was generated for a 35 lb./MSF basis weight two-ply linerboard which was calendered off-line. The roll temperature was identical (i.e., 400° F.) in all three methods, while the nipload was varied from 400 to 1,200 phi. Some of the samples were produced without moisturization prior to calendering, while other samples were moisturized to a level of 0.5% of the web weight by means of steam showers. All of the samples were surface sized. From this data, it can be inferred that both the hot soft nip calendering process and the hot hard calendering process produce a sheet where the microscale smoothness tracks the macroscale smoothness. On the other hand, the belt-calendered product can be calendered to have significant improvement in microscale smoothness without a substantial change in macroscale smoothness. In other words, in order to obtain the same level of microscale smoothness as a belt calendered product, the other calendering methods, hot hard and soft, have to attain a much higher level of macroscale smoothness. This can lead to heterogeneity in the densification of the paperboard as well as its compressibility that can be manifested as gloss mottle as well as print voids. Whereas hard calendering provides a constant (or uniform) caliper, the extended nip calender provides a constant (or uniform) sheet density. These results are illustrated in FIG. 5, where the printed properties of two-ply linerboard calendered under the best conditions using different methods are shown. All the samples that were tested for print quality were calendered at a roll temperature of 400° F. without any moisturization. The Sheffield smoothness values for each of the three products are very similar. The data shows that the gloss mottle decreases significantly for the belt-calendered product as compared to hot soft or hot hard calendered product, while the print void area (snowflake) decreases significantly for the beltcalendered product as compared to hot soft calendered product.

In accordance with the present invention, the multilayer linerboard need not be surface sized prior to extended nip calendering. In addition, the invention does not require that the extended nip calendering be performed on-line. Extended nip calendering may be performed off-line after the linerboard has cooled. Yet another variation involves cooling the web on-line prior to extended hot nip calendering. This can be accomplished using conventional cooling mechanisms such as water showers or cooling cylinders.

Figure 6:
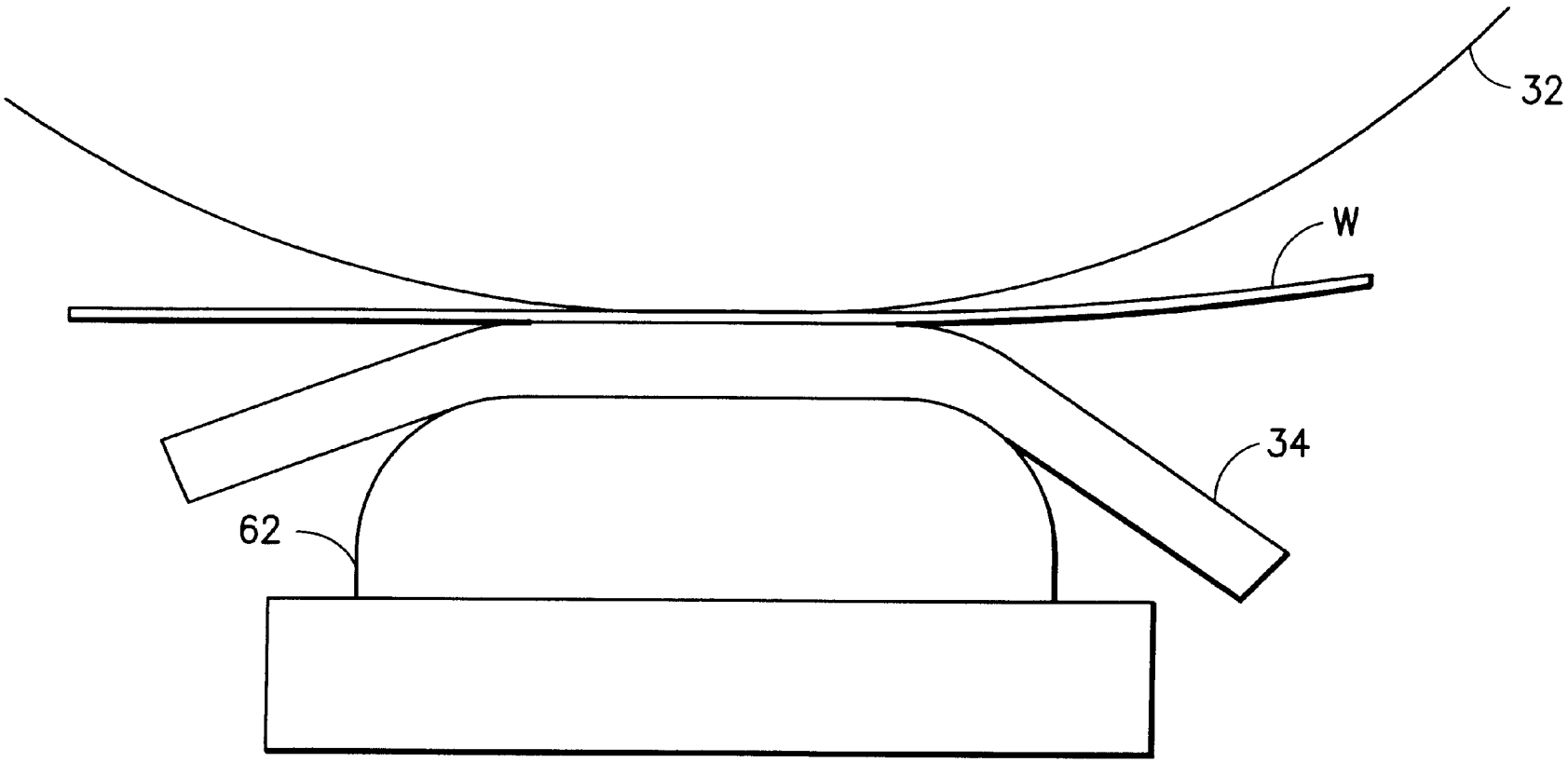
FIG. 6 is a diagrammatic view of an extended nip belt calendering arrangement in which the resilient belt is supported against the heated calender roll by means of a backing shoe.

In accordance with another preferred embodiment of the linerboard manufacturing apparatus, the backing roll can be replaced by a backing shoe to provide a greater nip width. An example of such an extended nip calendering arrangement is depicted in FIG. 6. This extended nip calendering arrangement comprises a heated calender roll 32, a conformable belt 34 made of resilient material and a backing shoe 62. The backing shoe 62 is urged toward the heated calender roll 32 by means of loading elements (not shown). During belt circulation, the belt 34 glides over the crown surface of the backing shoe. To reduce friction during gliding, lubricating oil is supplied between the bottom surface of the belt and the crown surface of the backing shoe by a system not shown in FIG. 6. The nip width is determined by the width of the crown of the backing shoe, the radius of the heated calender roll and the thickness of the belt.

The results achieved in an extended nip calender are determined in part by the properties of the belt. In particular, the modulus of elasticity of the belt affects the deformation of the belt in the nip. By making the belt of a very soft material, e.g., poly-urethane on a fabric substrate, web bulk can be saved during calendering.

The foregoing preferred embodiments of the invention have been disclosed for the purpose of illustration. Variations and modifications of the disclosed method of extended nip calendering will be readily apparent to practitioners skilled in the art. All such variations and modifications which do not depart from the concept of the present invention are intended to be encompassed by the claims set forth hereinafter.

What is claimed is:

1. A paperboard product comprising a top ply having a surface suitable for printing and at least one bottom ply, said top ply comprising bleached/unbleached virgin or recycled pulp and said at least one bottom ply comprising unbleached pulp, wherein said surface of said top layer has a Parker smoothness <6.5 and a Hagerty/Sheffield smoothness in the range of 240 to 280.

2. The paperboard product as defined in claim 1, wherein when the surface of said top layer has flexo printing thereon, said flexo printing has print voids in an amount less than 0.20% by area.

3. The paperboard product as defined in claim 1, wherein said surface of said top layer has sizing thereon.

* * * * *